United States Patent [19]

Kronz

[11] Patent Number: 4,673,118

[45] Date of Patent: Jun. 16, 1987

[54] SKI CARRYING APPARATUS

[75] Inventor: Kevin W. Kronz, Glendale, Ariz.

[73] Assignee: KevKel, Inc., Phoenix, Ariz.

[21] Appl. No.: 820,976

[22] Filed: Jan. 22, 1986

[51] Int. Cl.[4] ..... A45F 3/00

[52] U.S. Cl. ..... 224/259; 224/917

[58] Field of Search ..... 224/917, 901, 214, 209, 224/257, 259; 280/814

[56] References Cited

U.S. PATENT DOCUMENTS

| | | | |
|---|---|---|---|
| 995,458 | 6/1911 | Harriman | 224/214 |
| 1,334,582 | 3/1920 | Archibald | 224/214 X |
| 2,224,568 | 12/1940 | Altorfer | 224/917 X |
| 3,960,302 | 6/1976 | Mazzoni, Jr. | 224/917 X |
| 4,308,982 | 1/1982 | Hall | 224/917 X |
| 4,463,885 | 8/1984 | Ball et al. | 224/917 X |
| 4,518,107 | 5/1985 | Amos | 224/917 X |

FOREIGN PATENT DOCUMENTS

| | | | |
|---|---|---|---|
| 167940 | 8/1950 | Fed. Rep. of Germany | 224/917 |
| 2214104 | 9/1973 | Fed. Rep. of Germany | 224/917 |

*Primary Examiner*—Stephen Marcus
*Assistant Examiner*—Robert M. Petrik
*Attorney, Agent, or Firm*—H. Gordon Shields

[57] ABSTRACT

Ski carrying apparatus includes a flexible wrapping strip secured to a skier's back by a pair of straps. The wrapping strip includes two portions which wrap about a pair of skis, and straps secured to the wrapping strip secure ski poles to the wrapping strip and to the skis within the wrapping strip.

12 Claims, 6 Drawing Figures

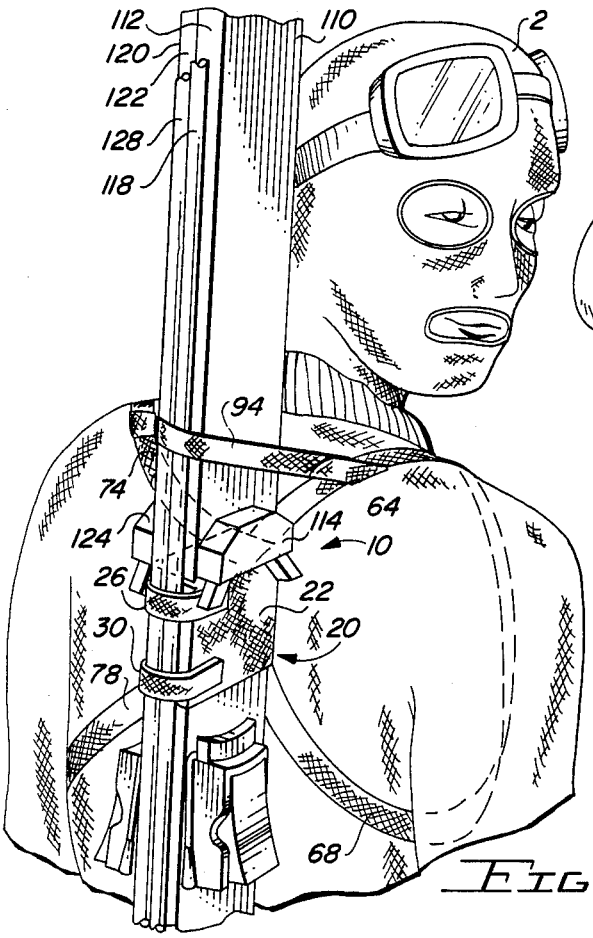
FIG. 1
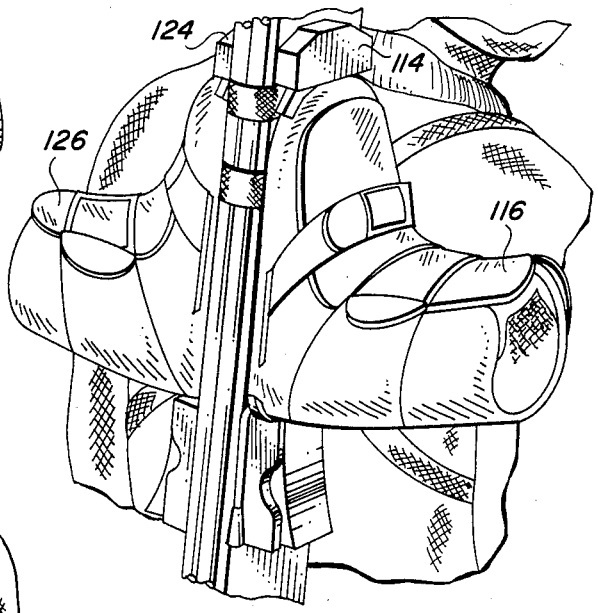
FIG. 2
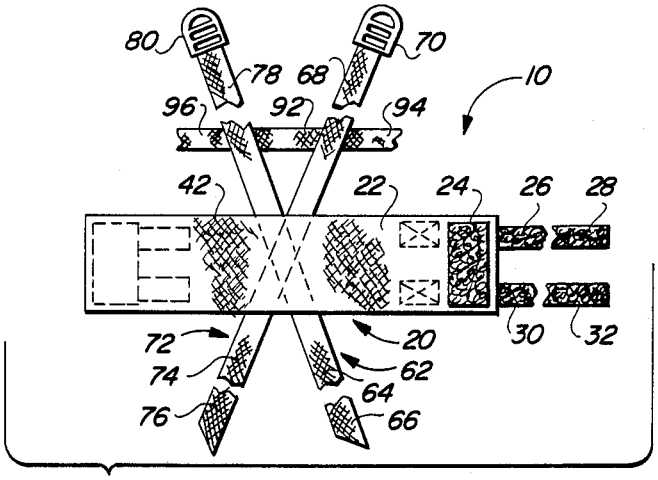
FIG. 3 FIG. 4
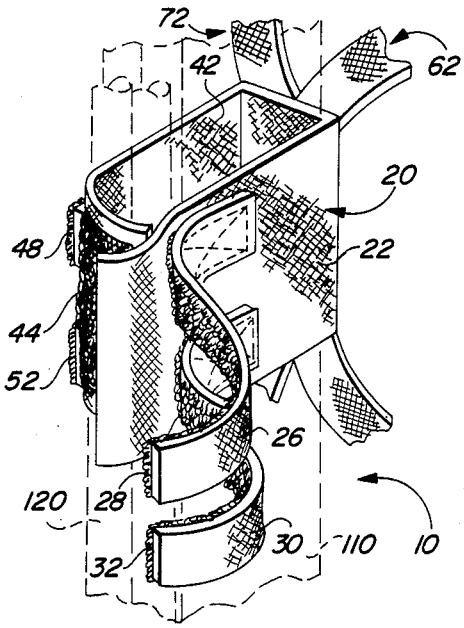
FIG. 5
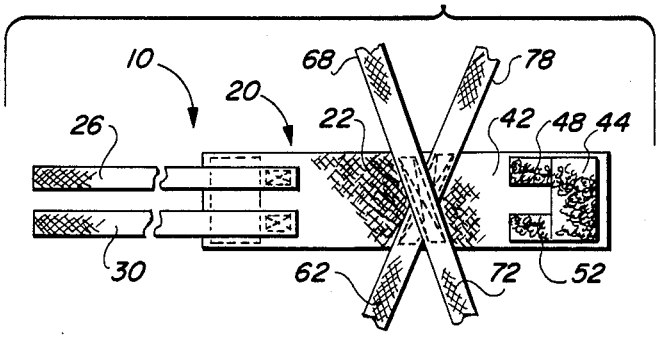
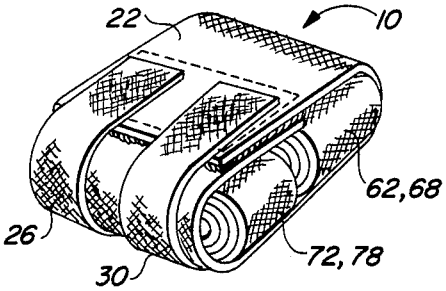
FIG. 6

SKI CARRYING APPARATUS

BACKGROUND OF THE INVENTION

1. Field of the Invention:

This invention relates generally to apparatus for carrying snow skis and related equipment and, more particularly, to a backpack type carrier for carying snow ski and related equipment and which may be rolled or folded into a relatively small, compact bundle for ease of carrying when not used as a ski equipment carrier.

2. Description of the Prior Art:

U.S. Pat. No. 2,224,568 (Altorfer) discloses a harness with a bag secured to the harness for carrying snow ski equipment. The harness crosses the shoulders of a user, and the harness secures to the bag and, in one embodiment, to skis extending upwardly from the bag. The apparatus also includes a strap which extends about a user's waist to secure the bag to the body. Alternate uses of the harness strap, which extends about a user's shoulder, are shown. One alternate use is to extend diagonally across the front of the user's body, with both ends of the strap secured to the bag at the back of the user. Another use is to secure a double loop around the user's shoulders, with one end of the loop secured to the bag and the other end of the loop to the belt at the front of the user. Alternatively, a loop may extend around a single shoulder and down under an arm, to connect to the skis above the shoulder, and at and below the arm to connect to the bag at the back or side of the user. The bag is of a fixed size, and includes two compartments. One compartment is open at the top for carrying the skis or other equipment, and the other bag includes a closed top for carrying other items.

U.S. Pat. No. 2,530,695 (Helmert) discloses a ski carrier and waist belt which includes a relatively long strap and two relatively shorter straps extending outwardly from the ends of the long strap. Each shorter strap includes a buckle at one end and holes in the strap at the other end to secure the straps at spaced-apart locations about a pair of snow skis and ski poles. With the shorter straps secured to the skis and poles, the relatively longer strap or belt portion is adapted to be disposed over the user's shoulder for carrying the skis. With the skis removed, the relatively long strap or belt portion extends about a user's waist, and the buckle portion of one shorter belt cooperates with the opposite end of the other relatively shorter strap to provide a single waist belt made of the three separate belts.

U.S. Pat. No. 2,118,875 (Windheim) discloses another type of ski carrying apparatus which comprises a relatively elongated bag which receives a pair of snow skis and ski poles. The bag includes a strap secured to one end of the lower portion of the bag and an upper portion which includes a shorter strap portion which extends about the skis and ski poles above the top of the bag. The strap then extends about the user's shoulder for carrying the bag and the skis.

In all three patents, the skis are carried vertically. In the '695 patent, the carrier becomes a belt disposed about the user's waist when not in use as a carrier. In the '568 patent, the apparatus is secured about the body of the user by changing the carrier strap to a different position and in a different manner from that user to transport the skis. The belt or strap about the user's waist remains such. In the '875 patent, the bag remains a relatively large and cumbersome object when not in use, while the strap remains fixed to the bag at only one end.

A second embodiment of the '875 apparatus includes the relatively long belt with a shorter belt at one end and a shorter belt at the opposite end. The shorter belts extend about a pair of skis and the ski poles, and the longer belt, which extends between the two shorter belts, then becomes a shoulder carrying strap for the skis. The use of the bag is thus obviated. The primary difference between the second embodiment in the '875 patent and the belt apparatus of the '695 patent is that each shorter strap at the ends of the longer strap or belt in the '695 patent pivots on the longer strap by means of a single rivet or pin. The pin or rivet is used to connect the shorter strap to the longer strap, and thus allows the shorter straps to pivot freely so that the three belts may comprise a single waist belt. In the '875 patent, the shorter straps remain extending substantially perpendicularly to the long strap, and the apparatus is thus not adapted to be disposed about a user's waist for carrying purposes.

In the three above-described patents, none of the carrier apparatus is adapted to be folded after use and put into a pocket. Rather, in two of the cases, the apparatus remains secured about the body of the user, and in the third patent the apparatus remains relatively large and cumbersome for carrying purposes. In a second embodiment of the third patent, the strap-only configuration without the bag, the strap apparatus may be folded for carrying, but it remains a relatively large and cumbersome unit and thus is not easily carried in a user's pocket.

None of the patents discussed above makes any reference to the carrying of ski boots. However, the second embodiment in the '875 patent discloses a situation in FIG. 4 which may include provisions for integral bindings or even ski boots, since the skis are shown disposed adjacent to each other with their bottoms or runners in a "face-to-face" orientation. However, the long carrying strap which extends between the two short straps and which are disposed about the skis and the ski poles is shown extending along or outwardly from the top of one ski, and thus aligned with a binding and a ski boot. If ski boots were to be secured in the bindings, the boots would dig into the user's back. Since there is no discussion in the specification, and the drawing is not clear, it is not known what provision, if any, is made for the carrying of ski boots. Since both ski boots and bindings have changed substantially since the '875 patent was filed in 1937 and was issued in 1938, it may very well be that the provision for carrying ski boots was not contemplated.

The ski boots were usually worn by the user and not carried separately. Also, the ski bindings were much different from those in contemporary use today. In some cases, the "bindings" in the skis extant in 1937 and 1938 consisted of little more than a strap which extended about a user's boots, or which included simply a toe socket into which a user's ski boot toes extended. The bindings which were later developed in the 1940's, the 1950's and the 1960's, and the bindings in contemporary use today obviously were not contemplated in the 1930's. Accordingly, the provision for the ski boots in contemporary usage today was not a problem and was not even considered in the design of ski carriers when any of the above-discussed patents were developed and were patented. In contemporary usage today, ski boots are relatively elaborate and complicated elements, as compared to foot wear generally worn to and from ski locations. Accordingly, the carrying of ski boots is of concern for contemporary skiers.

SUMMARY OF THE INVENTION

The invention described and claimed herein comprises carrying apparatus for skis in which a two-part primary carrier strap (wrap or strip) is disposed about a pair of skis. The skis are placed in a bottom-to-bottom or runner-to-runner orienation. The two-portion primary strap extends about the bindings between the toe pieces and the heel pieces of the skis, and one portion fastens to the other portion. The primary strap includes two smaller secondary straps which extend in generally the same direction as the two-portion strip. The secondary straps are then used to secure ski poles to the first two-portion strip and to the skis secured therein. A pair of carrying straps, which makes into a pair of double loops, is secured to the primary wrapping strap and extends about the user's shoulders and beneath the user's arms for securing the carrying straps and the skis and ski poles secured therein to the user's back. After the primary and secondary straps are secured to the skis and to the ski poles, the ski boots are secured to the bindings of the skis so that the skis, boots, and poles are all secured together.

Among the objects of the present invention are the following:

To provide new and useful apparatus for carrying snow skis;

To provide new and useful apparatus for carrying snow ski apparatus on a user's back;

To provide new and useful apparatus for carrying ski apparatus utilizing a plurality of belts or straps to secure the ski apparatus to a user's back and a plurality of belts or straps to secure the ski apparatus to the user;

To provide new and useful ski carrier apparatus which includes a primary strap and two secondary straps for securing to the ski apparatus, and a pair of carrier straps secured to the primary strap for securing the ski apparatus to a user, and To provide new and useful ski carrier apparatus which comprises a plurality of straps and which may be folded into a compact and easily carried bundle for carrying when the ski apparatus is removed.

BRIEF DESCRIPTION OF THE DRAWING

FIG. 1 is a perspective view of a user illustrating the apparatus of the present invention.

FIG. 2 is a perspective view of a portion of the apparatus of FIG. 1.

FIG. 3 is a plan view of the apparatus of the present invention.

FIG. 4 is a plan view of the reverse side of a portion of the apparatus of FIG. 3.

FIG. 5 is a perspective view of the apparatus of the present invention illustrating the use of the apparatus of the present invention.

FIG. 6 is a perspective view of the apparatus of the present invention folded for being carried.

DESCRIPTION OF THE PREFERRED EMBODIMENT

FIG. 1 is a rear perspective view of a skier 2, and of the skier's upper back portion 4 on which is disposed ski carrier apparatus 10 of the present invention in its use position. A pair of skis 110 and 120 is secured to the carrier apparatus 10. A pair of ski poles 118 and 128 is also secured to the apparatus 10. FIG. 2 is a perspective view of a portion of FIG. 1, showing a pair of ski boots 116 and 126 secured to the skis 110 and 120, respectively. The boots 116 and 126 have been omitted from FIG. 1 for purposes of clarity, but the ski bindings are shown in FIG. 1 in their closed or locked positions, as if the boots were in them.

In FIG. 3, the ski carrier apparatus 10 is shown in a plan view, with the apparatus 10 laid out or opened to illustrate the various components or elements.

The ski carrying apparatus 10 includes a wrapping strip 20, which may be referred to as a primary wrapping strip or strap. The wrapping strip 20 includes two portions, a first portion 22 and a second portion 42. Secured to the first strip portion 22, and extending outwardly therefrom, are a pair of secondary wrapping strips or straps 26 and 30.

FIG. 4 is a plan view of the primary wrapping strip 20 and its secondary wrapping strips or straps 26 and 30 reversed from the showing in FIG. 3. FIG. 3 shows the "inside" of the primary wrapping strip 20 and of the secondary straps 26 and 30. FIG. 4 shows the "outside" of the primary wrapping strip 20 and of the secondary straps 26 and 30.

FIG. 5 shows the ski carrier apparatus 10 with the primary wrapping strip 20 disposed about the skis 110 and 120. the skis 110 and 120 are shown in phantom, and the two portions 22 and 42 of the wrapping strip are about to be secured together. The secondary fastening straps 26 and 30 are shown in their open positions, ready to be disposed about the ski poles 118 and 128. However, ski poles are only shown in FIG. 5 in phantom.

For the following discussion, reference will primarily be made to FIGS. 1, 2, 3, 4, and 5.

The wrapping strip 20 extends generally horizontally in its use position, as shown in FIGS. 1, 2, 3, 4, and 5. The two portions 22 and 42 extend outwardly or away from each other, but are in reality simply continuations of the same strip. The two portions are referred to simply as "portions" for convenience in illustrating them and in discussing them. The juncture or the dividing line between the two portions 22 and 42 is generally the central area of the primary wrapping strip 20, where a pair of straps 62 and 72 are secured to the wrapping strip 20. The straps 62 and 72 are carrying straps for securing the wrapping strip 20, and the ski elements or components, to the upper back 4 of the user, namely the skier 2. The straps 62 and 72 are preferably sewn to the wrapping strap 20 in a well known and well understood manner.

The "inside" of the wrapping strip 20, as shown in FIG. 3, is adapted to be disposed about and against the skis 110 and 120, as shown in FIG. 1 and as also shown in FIG. 5. Only the portions of the skis 110 and 120 associated with the strip 20 are shown in FIG. 5, and they are only shown in phantom.

The two portions 22 and 42 of the wrapping strip 20 are secured together by appropriate fastening elements 24 and 44 on the portions 22 and 42 respectively. The fastening elements 24 and 44 are preferably "Velcro" type fastening elements. The fastening elements 24 are preferably secured to the inside of the first portion 22 at the outer or distal end of the first wrapping strip portion 22, remote from where the carrying straps 62 and 72 are secured to the wrapping strip. The fastening elements 44 are preferably fastened to the outside of the second portion 42 of the wrapping strip 20. The elements 44 are adjacent to the outer or distal end of the second portion 42, again remote from where the carrying straps 62 and 72 are secured to the wrapping strip 20. In securing the two portions 22 and 42 together, as best shown in FIG. 5, the outer end of the first portion 22 overlaps the outer end of the second portion 42. The fastening elements 24 mesh with the fastening elements 44 to secure the two portions 22 and 42 together, with the skis 110 and 120 disposed and held within the wrapping strip 20 by the engagement of the fastening elements 24 and 44 on the two portions 22 and 42, respectively, of the wrapping strip 20.

As best shown in FIG. 1, the ski 110 includes an outer edge 112. The edge 112 is defined as the edge remove from the back 4 of the user 2 when the skis are secured to the ski carrying apparatus 10. The ski 110 also includes a binding 114. The ski boot 116 is shown secured to the binding 114 of the ski 110 in FIG. 2.

The ski 120, for purposes of the present invention, is substantially a mirror image of the ski 110. It includes an outer edge 122. the edge 122 is also defined as the edge of the ski 120 remote from the back 4 of the user 2 when the skis 110 and 120 are secured to the ski carrier apparatus 10. The ski 120 also includes a binding 124, and a boot 126 is shown disposed within the binding 124 in FIG. 2.

The primary wrapping strip 20 is disposed about the skis 110 and 120 between the two pieces and the heel pieces of the bindings 114 and 124, respectively, of the skis. The wrapping strip 20 is disposed just below the toe pieces of the bindings so that the pieces act as upper stops for the strip 20 to prevent the skis from slipping downwardly in the apparatus 10. Since the wrapping strip 20 is relatively thin and flexible material, such as nylon, the ski boots 116 and 126 may be secured to their respective bindings 114 and 124 after the wrapping strip 20 has been secured to the skis 110 and 120. The first portion 22 of the wrapping strip 20 is disposed beneath the boot 116, and the second portion 42 of the wrapping strip 20 is disposed about the binding 124 and beneath the boot 126 of the ski 120. In this manner, the skis and bindings are secured to the back 4 of the user 2.

The pair of secondary straps, comprising the top strap 26 and the bottom strap 30, are appropriately secured (as by sewing) to the outside of the first portion 22 of the wrapping strip 20. The secondary straps 26 and 30 extend outwardly generally parallel to the wrapping strip 20. The secondary straps 26 and 30 are preferably stitched to the first portion 22 inwardly from its outer edges. This is best shown in FIGS. 4 and 5. It is also shown in FIG. 1. The secondary straps 26 and 30 include free ends remote from where they are secured to the wrapping strip portion 22.

On the inner surfaces of the free ends of the straps 26 and 30 are fastening elements 28 and 32, respectively. The fastening elements 28 and 32 cooperate with a pair of fastening elements 48 and 52, which are secured to the outside of the second portion 42 of the wrapping strip 20. The fastening elements 48 and 52 are fastened inwardly from the outer edge of the second portion 42, and adjacent to the fastening elements 44, as shown best in FIG. 3. The fastening elements 28, 32, and 48, 52 are preferably also "Velcro" type elements, and each is respectively substantially like its adjacent fastening elements 24 and 44, respectively. That is, the fastening elements 24, 28, 32 are substantially alike, and their cooperating fastening elements 44, 48, 52 are substantially alike, thus providing the necessary and cooperating fastening elements required for securing the respective strips and straps together.

After the first portion 22 of the wrapping strip 20 has been disposed or wrapped about the skis 110 and 120, and has been secured to the second portion 42 of the wrapping strip 20, the carrier apparatus 10 is ready to receive the pair of ski poles 118 and 128. The ski poles 118 and 128 are preferably disposed adjacent to, and against, the outer edges 112 and 122 of the skis 118 and 120, respectively. This is best shown in FIGS. 1 and 2. The ski poles 118 and 128 are secured against the outer edges 112 and 122 by means of the secondary fastening straps 26 and 30. This is also best shown in FIGS. 1 and 2.

Referring to FIG. 3, after the outer end of the first portion 22 of the primary wrapping strip 20 is disposed against the outer end of the second portion 42 of the wrapping strip 20, to secure the skis 110 and 120 to the carrier apparatus 10, the secondary straps 26 and 30 are ready to be disposed about the ski poles 118 and 128. The cooperating fastening elements hold both the skis 110 and 120, as well as the skis poles 118 and 128, together as a unified package. As previously indicated, and as shown in FIG. 2, the ski boots 116 and 126 are secured to the respective ski bindings 114 and 124 of the skis 110 and 120, respectively. Thus, all of the ski apparatus is integrated or unified together and held by the apparatus 10.

The skis remain in a vertical, or upright, position, as shown in FIGS. 1 and 2, and thus are not likely to interfere with walking or other movement of the user. The ski boots extend outwardly from the skis generally parallel to the back 4 of the user, and they are out of the way and are not likely to interfere with the skier 2 or with other people (not shown) adjacent to the skier 2 as the skier walks.

The wrapping strip 20, with the ski apparatus disposed therein, is secured to the skier 2 by means of the pair of straps 62 and 72. The straps 62 and 72 are disposed at an angle with respect to each other and to the wrapping strip 20 so as to conveniently extend about the shoulders and arms of the user, as best shown in FIG. 1.

The strap 62 includes a lower portion 64 and an upper portion 68. The upper portion 68 includes buckle 70 at its outer end, remote from the wrapping strip 20. The strap 62 includes the lower portion 64 with a tip 66 at its outer end, which is also remote from the wrapping strip 20. The buckle 70 is adapted to engage the tip 66 so that the two portions 64 and 68 may be secured together. The two carrying strap belt portions 64 and 68, when secured together, comprise a loop which extends over the shoulder and under the arm of the user. As shown in FIG. 1, the upper portion 68 extends over the right shoulder of the user 2, and the lower portion 64 extends beneath the right arm of the user, and the two portions 64 and 68 are then appropriately fastened together by means of the buckle 70 and the tip 66.

The strap 72 is substantially a mirror image of the strap 62. It includes a lower portion 74 and an upper portion 78. The upper portion 78 terminates in a buckle 80, and the lower portion 74 terminates in a tip 76. The buckle 80 and the tip 76 cooperate to secure the two portions 74 and 78 together.

The upper portion 78 and the lower portion 74, when secured together, also comprise a loop. The upper portion 76 extends over the left shoulder of the user 2, and the lower portion 74 extends beneath the left arm of the user 2.

As shown in FIGS. 3 and 4, the two portions, upper and lower of the pair of straps extend at angles with respect to each other for convenience in defining their respective shoulder and arm loops. That is, the upper and lower portions are not aligned with each other and the straps 62 and 72 are not parallel to each other. As may be deduced from FIGS. 3 and 4, the upper portion 68 and the lower portion 74 appear to be aligned continuations of each other, extending in opposite directions. The portions 78 and 64 also appear to be aligned continuations of each other, extending in opposite directions. The belts or straps 62 and 72 intersect at an acute angle to make up their respective loops. The straps 62 and 72 also extend at acute angles with respect to the wrapping strip 20, with the upper and lower portions of each strap extending oppositely from each other, at the same acute angle, with respect to the wrapping strip 20.

While the straps 62 and 72 are shown disposed at an acute angle with respect to each other, they also may be parallel with each other, and spaced apart from each other as they are secured to the primary wrapping strap 20. As indicated, the straps 62 and 72 are shown at an acute angle with respect to each other for convenience in forming loops with the straps for carrying purposes. In the straps are parallel to each other, the formation of the carrying loops is not quite as convenient as with the angular carrying straps. However, there may be advantages in a parallel alignment of the straps, such as providing a more stable support for the primary carrying strap 20 and for the skis and ski poles secured thereto.

As is known and understood, skis and ski poles are relatively long, and in the natural walking motion or gait of a user of the skis and of the ski carrying apparatus 10 of the present invention, the rhythmical movement of the user and the skis may cause the skis and ski poles to tilt or to move sideways. With the straps 62 and 72 at an acute angle to each other, the crossing location of the straps on the primary wrapping strip 20 may become almost a natural pivot point about which the skis and ski poles may move as a user walks. Hence, a parallel alignment of the straps may be advantageous.

However, even with the carrying straps 62 and 72 parallel to each other and spaced apart, the entire primary carrying strip 20 may become, in essence, a pivot point about which the skis and ski poles may tend to move as a user walks. To help stabilize the skis and ski poles in the carrying apparatus 10, a cross strap 92, shown in FIG. 3, is preferably secured to the upper portions 64 and 74, respectively, of the first and second straps 62 and 72. The cross strap 92 maintains the upper portions 64 and 74 in a maximum, fixed relationship to each other.

In addition to the cross strap 92, a pair of stabilizing straps 94 and 96 are then secured respectively to the upper portions 64 and 74 of the first and second straps at the same location as the cross strap 92 is secured to the upper straps. In essence, the cross strap 92 and the stabilizing straps 94 and 96 are simply a continuous strap, but secured to the first and second straps in a permanent relationship, as by stitching. The stitching, now shown, is substantially the same as the stitching shown in FIGS. 3, 4, and 5 for the straps 26, 30, 62, 78, and 68, 72. Such stitching is well known in the art.

The stabilizing straps 94 and 96 are adapted to be disposed about the skis and ski poles, as shown in FIG. 1, above the primary wrapping strip 20. As the term "stabilizing" would indicate, the straps 94 and 96 help to maintain the skis 110 and 120, and the ski poles 118 and 128, in an upright position, as shown in FIGS. 1 and 2, while the skier 2 moves. The vertical relationship or orientation of the skis and ski poles is maintained with the aid of the stabilizing straps. This, of course, negates the tendency of the skis and ski poles to move or twist or pivot as the skier 2 walks.

At the outer ends of the stabilizing strips 94 and 96 are appropriate cooperating "Velcro" type fasteners. The "Velcro" type fasteners allow the straps 94 and 96 to be secured to each other, and about the skis and ski poles, in a manner similar to the manner in which the primary wrapping strip and the secondary wrapping straps are secured together.

The cross straps 92 and the stabilizing straps 94 and 96 are used with both angular and parallel carrying straps.

The skis 110 and 120 and the ski poles 118 and 128 are thus secured to the user 2 by the carrying apparatus 10 at two longitudinally spaced apart locations. The two spaced apart locations provide stability and security and maintains the skis and ski poles at a vertical orientation, generally aligned with the skier, regardless of the movements of the skier. The skis and ski poles maintain their parallel relationship with respect to the back or spine of the user regardless of the movements of the user.

After arriving at a desired location for skiing, the user 2 removes the carrier apparatus 10, with the ski apparatus secured thereto, by either unfastening the carrying strap ends and buckles, or by slipping out of the carrying strap loops. In any event, after removing the carrier apparatus 10, the ski apparatus is then removed from the carrying apparatus 10 in the reverse order from which the apparatus was secured to the carrier apparatus 10. Thus, the ski poles 118 and 128 are first removed from the carrier apparatus 10 by removing the stabilizing straps 94 and 96 and then the secondary straps 26 and 30, and then the skis 110 and 120 are released by unfastening the first and second portions 22 and 42, respectively, of the primary wrapping strip 20. The ski boots 116 and 126 are released from the bindings 114 and 124, respectively, so that the primary wrapping strip 20 may be completely removed from the skis.

After the ski equipment is removed from the ski carrier apparatus 10, the strap or belt portions 64, 68, 74, 78, and 94, 96 of the carrying straps 62 and 72, respectively, are appropriately folded within the wrapping strip 20, as shown in FIG. 6. The wrapping strip 20 is then disposed about the folded straps 62 and 72. Finally, the secondary straps 26 and 30 are wrapped about the wrapping strip portions 22 and 42 to provide the relatively compact folded bundle illustrated in FIG. 6.

Since the folded belts 62 and 72 may be less in both overall width and thickness than the combined width and thickness of the skis 110 and 120 and the bindings 114 and 124, it may be necessary to add cooperating fasteners for the outer ends of the secondary straps 26 and 30. That is, with the primary wrapping strap or strip 20 disposed about the folded carrying straps 62 and 72, and the secondary straps 26 and 30 wrapped about the strip 20, the fastening elements 28, 48, and 32, 52 may not match. Accordingly, it may be necessary to add additional patches of fastening elements, of the same type as the fastening elements 48 and 52, for the ends of the fastening elements 28 and 32 in order to secure the apparatus in the folded compact bundle shown in FIG. 6 for carrying and storing the apparatus.

While the principles of the invention have been made clear in illustrative embodiments, there will be immediately obvious to those skilled in the art many modifications of structure, arrangements, proportions, the elements, materials, and components used in the practice of the invention, and otherwise, which are particularly adapted for specific environments and operative requirements without departing from those principles. The appended claims are intended to cover and embrace any and all such modifications, within the limits only of the true spirit and scope of the invention. This specification and the appended claims have been prepared in accordance with the applicable patent laws and the rules promulgated under the authority thereof.

What I claim is:

1. Ski carrying apparatus for carrying a pair of skis and a pair of ski poles, comprising, in combination:

wrapping strip means, including a first wrapping strip portion, a second wrapping strip portion for holding a pair of skis, and first fastening means for securing the first wrapping strip portion to the second wrapping strip portion;

first strap means secured to the wrapping strip means for securing a pair of ski poles to the wrapping strip means and to the pair of skis, including second fastening means having a first fastening portion secured to the first scrap means, and a second fastening portion secured to the second wrapping strip portion, and the first fastening portion and the second fastening portion cooperates to secure the first strap means the ski poles to the wrapping strip means and to the pair of skis; and second strap means secured to the wrapping strip means to secure the wrapping strip means and the pair of skis and the first strap means and the pair of ski poles to a user's back.

2. The apparatus of claim 1 in which the first strap means is secured to the first wrapping strip portion and includes a free end removably secured to the second wrapping strip portion.

3. The apparatus of claim 1 in which the first strap means includes a first strap and a second strap spaced apart from each other and generally parallel to each other.

4. The apparatus of claim 3 in which the first and second straps are secured to the first wrapping strip and extend outwardly therefrom.

5. The apparatus of claim 4 in which the first and second straps each include a free end removably secured to the second wrapping strip.

6. The apparatus of claim 1 in which the second strap means includes a third strap and a fourth strap for securing the wrapping strip means, the first strap means, and the skis and ski poles, to the user's back.

7. The apparatus of claim 6 in which the second strap means is foldable, and the wrapping strip means is foldable about the folded second strap means, and the first strap means are wrapped about and secured to the wrapping strip means to secure the first strap means, the wrapping strip means, and the second strap means together in their folded and wrapped state to define a compact bundle for carrying and storing.

8. The apparatus of claim 6 in which the second strap means further includes stabilizing strap means for stabilizing the skis and ski poles on the user's back.

9. The apparatus of claim 8 in which the stabilizer strap means includes a first stabilizing strap secured to the third strap and a second stabilizing strap secured to the fourth strap, and the first stabilizing strap and the second stabilizing strap are securable to each other.

10. The apparatus of claim 9 in which the stabilizing strap means further includes a cross strap secured to and extending between the third and fourth straps.

11. Ski carrying apparatus for carrying skis and ski poles, comprising, in combination:

wrapping strip means, including a first wrapping strip portin and a second wrapping strip portion for holding a ski;

first strap means secured to the wrapping strip means for securing a ski pole to the wrapping strip means and to the ski, including a first strap secured to the first wrapping strip and having a free end removably secured to the second wrapping strip, and a second strap secured to the first wrapping strip and having a free end removably secured to the second wrapping strip; and second strap means secured to the wrapping strip mens to secure the wrapping strip means and the ski and the first strap means and the ski pole to a user's back.

12. The apparatus of claim 11 in which the first and second straps are spaced apart from each other and are generally parallel to each other.

* * * * *